US005511277A

United States Patent [19]

Simonds

[11] Patent Number: 5,511,277

[45] Date of Patent: Apr. 30, 1996

[54] TOOTHBRUSH

[76] Inventor: James A. Simonds, 3335 Scrub Oak Dr., Santa Rosa, Calif. 95404

[21] Appl. No.: 470,645

[22] Filed: Jun. 6, 1995

Related U.S. Application Data

[63] Continuation of PCT/US94/12696, Nov. 4, 1994, and a continuation of Ser. No. 220,539, Mar. 31, 1994, abandoned, which is a continuation-in-part of Ser. No. 147,756, Nov. 5, 1993.

[30] Foreign Application Priority Data

Nov. 4, 1994 [WO] WIPO ..... PCT/US94/12696

[51] Int. Cl.[6] ..... A46B 9/04

[52] U.S. Cl. ..... 15/167.1; 15/172

[58] Field of Search ..... 15/172, 167.1, 15/167.2, 185, 143.1, 144.1, 176.1, 174.4, 174.5, 174.6

[56] References Cited

U.S. PATENT DOCUMENTS

| | | | |
|---|---|---|---|
| 2,122,619 | 7/1938 | McMath | 15/172 |
| 4,170,803 | 10/1979 | Saito | 15/144.1 |
| 4,457,039 | 7/1984 | Massari | 15/143.1 |
| 4,488,328 | 12/1984 | Hyman | 15/167.1 |
| 4,667,360 | 5/1987 | Marthaler et al. | 15/167.1 |
| 4,712,266 | 12/1987 | Yamaki | 15/172 |
| 4,809,388 | 3/1989 | Dietrich | 15/143.1 |
| 5,105,499 | 4/1992 | Dirksing | 15/172 |
| 5,114,214 | 5/1992 | Barman | 15/172 |
| 5,121,520 | 6/1992 | Brice | 15/167.1 |
| 5,228,166 | 7/1993 | Gomez | 15/172 |
| 5,247,718 | 9/1993 | Victorian | 15/176.1 |
| 5,269,038 | 12/1993 | Bradley | 15/167.1 |

FOREIGN PATENT DOCUMENTS

| | | | |
|---|---|---|---|
| 454625 | 10/1991 | European Pat. Off. | 15/167.1 |
| 489640 | 10/1918 | France | 15/1918 |
| 1070224 | 2/1954 | France | 15/172 |
| 2277547 | 6/1976 | France . | |
| 283131 | 4/1915 | Germany | 15/172 |
| 412232 | 11/1966 | Switzerland | 15/144.1 |
| 109877 | 10/1917 | United Kingdom | 15/144.1 |

*Primary Examiner*—David Scherbel
*Assistant Examiner*—Tony G. Soohoo
*Attorney, Agent, or Firm*—Corwin R. Horton

[57] ABSTRACT

An articulate toothbrush particularly suitable for integral molding having a handle with an elongate grip and a support section extending from the grip to the brush head with an arch shape. The arch has a leg that returns toward the longitudinal axis of the grip at an acute angle to a connection with a brush head. The brush head has a longitudinal axis and terminates along that axis in a heel in the direction of the grip of handle and in a toe in the direction away from the grip. The top of the brush head is proximal to the distal leg of the support and the bottom of the brush head which is distal to the distal leg, has bristles depending therefrom. The distal leg of the support is connected to the top of the brush head at a medial position along the brush head longitudinal axis by a flexible plastic hinge. The hinge is narrow in the direction parallel to the brush head longitudinal axis and wide in the transverse direction, relative to its thickness in the parallel direction to thereby create a hinge axis of rotation generally normal to longitudinal axis of the grasp and to the longitudinal axis of the brush head for relative pivotal movement between the brush head and the handle over a desired acute angle arc.

20 Claims, 2 Drawing Sheets

TOOTHBRUSH

This is a continuation of application Ser. No. 08/220,539, filed Mar. 31, 1994, and International Application PCT/US94/12696, filed Nov. 4, 1994, and which designated the U.S. now abandoned.

This application Ser. No. 220,539 is a continuation-in-part of copending patent application Ser. No. 08/147,756 filed Nov. 5, 1993, for a TOOTHBRUSH.

BACKGROUND OF THE INVENTION

1. Field of the Invention

This invention relates generally to dental hygiene techniques and apparatus, and more specifically to an improved toothbrush mechanism to efficiently accommodate cleaning sites in the mouth.

2. Description of the Prior Art

Toothbrushes have been designed to clean teeth by removing plaque and food debris with brush bristles of various dimensions, firmness, materials, and retention methods. Originally, and dating back several centuries, the toothbrush had a design of brush bristles mounted on a handle which carried the bristles into the mouth. The fixed nature of the brush handle required that the user manipulate the brush into exact position before activating the brushing motion. Variations of brush design from uneven bristle heights to "serrated" designed bristle patterns attempted to enable bristles to extend between the teeth for greater cleansibility. However, the brush handle and head were always rigidly fixed in one position.

Some toothbrush designs have provided rotational brush heads rotating on an axis parallel to the axis described by the brush head bristles and perpendicular to the targeted tooth surfaces. However, they have no rotation to accommodate the curvature of the dental arch.

Other toothbrush designs attempted to create better hygiene access through changing the angulation between the brush head and the brush handle. These designs had a number of proposed angulations between the head and handle, but the head and handle were fixed in place relative to each other regardless of the angulation.

The design of toothbrushes with an angled head had either single or double (binangled) bends in the connector. The head was angled toward the targeted teeth. The intention of the bend was to allow the brush to function around the corners of teeth and on the inside (tongue side) surfaces of teeth that either could not be reached by conventional straight brushes or would be highly demanding of the operator to adjust the straight brush to reach these surfaces. Despite this improvement over straight designs, the rigid fixture of the head to the handle could not adapt to various angles of access and presented an abnormal relationship of brush head to teeth when a straight brush design might serve best.

Some of these angled designs also suffered from design imbalance. A balanced toothbrush is designed so that the brush head meets a line that extends from the longitudinal axis of the handle. The farther the brush head is from this axis line, the more out of balance the brush is. The greater the brush imbalance, the greater amount of force must be applied to the handle to activate the bristles on the brush head.

One variation included a spring-like member on the handle designed to absorb excess forces applied to the brush to prevent tooth abrasion, but it yielded control while relieving stress. In addition, there was little or no true rotation of the brush head itself to offer improves access for improved hygiene.

SUMMARY OF THE INVENTION

The improved toothbrush of this invention provides a modified toothbrush structure to efficiently accommodate cleaning sites in the mouth. The inventive toothbrush comprises a handle with an elongate grip and a support section extending from the grip to the brush head with an arch shape. The arch has a leg proximal to the grip that diverges outwardly of the longitudinal axis of the grip and a leg that is distal to the grip and that returns toward the longitudinal axis of the grip at an acute angle with that axis to a connection with the brush head. The brush head has a longitudinal axis and terminates along that axis in a heel in the direction of the grip of handle and in a toe in the direction away from the grip. The top of the brush head is proximal to the distal leg of the support and the bottom, which is distal to the distal leg, has bristles depending therefrom and distributed therealong from the heel to the toe. The distal leg of the support is connected to the top of the brush head at a medial position along the brush head longitudinal axis by a flexible plastic hinge. The hinge is narrow in the direction parallel to the brush head longitudinal axis and wide in the transverse direction, relative to its thickness in the parallel direction to thereby create a hinge axis of rotation generally normal to longitudinal axis of the grasp and to the longitudinal axis of the brush head for relative pivotal movement between the blush head and the handle over a desired acute angle arc.

While the copending application describes a toothbrush which uses a three-piece design with one piece extending from the handle into a ball and socket type of arrangement between the two pieces of the toothbrush head, the embodiment of this application achieves the same rotating motion by utilizing a flexible joint permanently attached to the lower portion of the brush head. The handle of the brush is thus permanently attached in position to the lower portion of the brush head by a broad flexible joint. The top portion of the brush head is itself attached to the lower portion of the brush head by a narrow, flexible hinge at the tip of the brush head that is wide in the direction transverse to the longitudinal axis of the brush head, relative to the indicated narrow breadth of the hinge in the direction along that axis.

The inventive brush is assembled by folding the top portion of the brush head over the joint area where the brush handle joins the lower portion of the brush head, and sealing it to the lower portion of the brush head. A single slot in the top portion of the brush head will allow for limited freedom of movement in the rotating action of the brush head. Finish and polish of the brush head may be used to remove the hinge at the tip of the brush head which is no longer needed since the top is now sealed to the bottom of the blush head. The finished appearance is nearly identical to the embodiment described in the copending application, and it shares the same structural benefits (degree of rotation, position of the rotational axis, balance of the instrument along the center axis of the handle, etc.).

The two portions of the brush head may be permanently sealed together during fabrication by heat, polymerizing cement, adhesive, mechanical fixation, or other bonding mechanism. An alternative, however, is a snap-together mechanism which can be unsnapped and opened for cleaning. A fingernail hold or "lip" can be built into the "heel" of the brush head on each of the two distally extending portions of the top part of the brush head.

The advantages of this design include:

The permanent attachment of the head to the handle which effectively eliminates any possibility of inadvertent separation.

Simplified fabrication by enabling the use of a single mold rather than multiple molds.

The flexible joint between the head and the handle saves space and could allow for longer toothbrush bristles without increasing the width of the brush (the dimension extending from the tips of the bristles to the back of the brush head).

Other variations of this modification may include:

The hinge which connects the top and bottom portions of the brush head may be recessed into the brush head so it does not protrude from the tip of the brush head. The smoothness of the brush head reduces possibilities of tissue irritation and contributes to the aesthetic contours of the brush head.

For permanently sealed versions, the hinge may be trimmed off after the top and bottom parts of the brush head have been bonded together. This is done during the process of finishing the surfaces of the brush. The objective of this variation is to utilize the benefits of the hinge during production while eliminating it in the final brush since is non-functional in a permanently bonded brush head.

The inventive toothbrush provides a pivotable brush head where the axis of the rotation of the brush head is perpendicular to both the longitudinal axis of the handle and to the brush bristles. This rotational axis is roughly parallel to long axis of the teeth targeted for cleaning and can align itself to match the surfaces of the teeth as it follows the arch or curvature of the dentition.

The inventive brush is strong yet narrow in dimension to be relatively equivalent to the, width of other toothbrushes. The secured, fixed attachment of the head of the brush to the handle precludes the risk of inadvertent release of the brush head.

The inventive brush was designed around the principles of oral hygiene and safety. There are only two parts that move relative to one another, and the juncture of these parts is enclosed and protected. The bulk of the connector from the handle is preserved providing strength, and the connection of parts which encases the connector from the handle are permanently bonded. The exterior design of the brush head not only protects the flexible joint in plastic, but protects the user from irritation from moving parts through the smooth shape of surrounding plastic. Surfaces between moving parts are kept as flush as possible and in positions that would be least likely to engage tissue. The design blends its utility with the simple and attractive appearance of the brush head.

The design of the brush is sensitive to the broad range of abuse that toothbrushes commonly receive. It can be used by unskilled people with little risk of breakage or damage. The nearly full coverage of the connector on the brush adds security to linkage of the brush head to the handle and limited rotation reduces stress on the connector. The handle of inventive brush has an arch-shaped support or connector extending to the brush head which allows the brush to reach around obstacles such as front teeth and be able to reach back teeth including the distal (back surface area) of posterior teeth. This arch-shaped design also allows for freedom of rotation of the brush head without interference from the handle.

The connector from the brush handle of the brush attaches to the brush head within a confined and protected space without consuming the entire width of the brush head. This allows for adapting many different sizes and shapes of brush heads while maintaining the protective strength of the connector.

The position of the rotation on the brush head is near the midline of the brush but slightly anterior to the midline of the brush head. As can be seen by reference to the FIGS. 5 illustrating the preferred embodiment, it is preferred for the axis of rotation to be at a position anterior to the midline that is closer to the midline than it is to toe of the brush head. This will assure adequate cleaning pressure at the tip of the brush and assures the tip of the brush will follow the contours of the teeth far into back parts of the mouth.

The inventive brush could accommodate a variety of brush head profiles. One preferred brush head design is triangular with a compact size and rounded edges to permit access with safety to reach confined areas within the mouth.

The inventive brush maintains a quality of "balance" not explicit in prior art toothbrushes. Balance is defined as the longitudinal axis from the handle intersecting the point of rotation of the brush head. The benefit is that the shorter the radius between the point of brush head rotation and this axis will minimize the amount of applied stress needed to activate the brush and increase the comfort for the user since any torquing or twisting effect of having the rotation point off this line will be minimized. The longer the radius, the more twisting action of the brush handle will be necessary to activate it or control it.

The inventive brush defines a limit to maximum rotation of 25–35 degrees. In a similar vein, the starting point of rotation is fixed when the flat surface of the brush head (perpendicular to the bristles) is parallel to the flat dominate portion of the brush handle. The rotation occurs as an action of the tip of the brush descending as the heel of the brush head rotates up toward the brush handle. This limitation of rotation is intended to increase the control of the user while allowing for sufficient rotation action to adjust to variations of tooth surfaces. The range of rotation is designed to be aesthetic and not too radical to increase its acceptance by current users of conventional brushes. The limitation of rotation also restricts the range of action of the connector and preserves its structural integrity.

The freely rotating brush head rotates with each stroke and the toe and heel of the brush head has a tendency to "dive" in between teeth. This accentuates its cleaning activity. Equally significant, this action clearly discourages a broad "scrubbing" technique by users which is known to be a primary cause of toothbrush abrasion and associated maladies including gingival (gum) recession, tooth abrasion and formation of grooves on teeth, root sensitivity, etc.

DETAILED DESCRIPTION OF A PREFERRED EMBODIMENT

Figure 1:
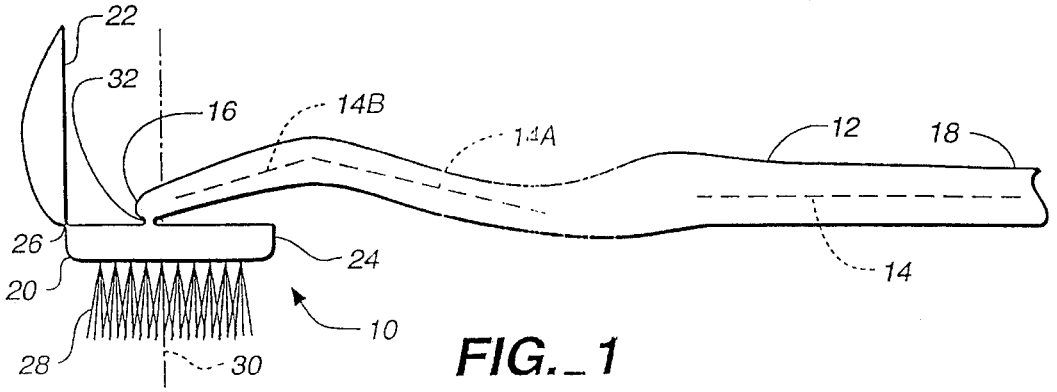
FIG. 1 is a side elevation view of an improved toothbrush of this invention illustrating the component parts and showing the toothbrush in unassembled form as an integrally molded blank ready for assembly.

FIG. 1 is a side elevation view of an improved toothbrush 10 of this invention illustrating the component parts including a handle 12 having an elongate section or grip having a longitudinal axis 14, which for gripping bar the user. Extending generally outward of the grip in the general direction of axis 14 is a support section of handle 12 having a generally arch-shaped portion. The arch-shaped portion has a leg proximal to the grip that extends outwardly of axis 14 at an acute angle, along its longitudinal axis 14*a*, and a leg distal to the grip that extends back toward axis 14, along its longitudinal axis 14*b*, to end 16 of handle 12 at a flexible hinge connection 32 with a brush head 2C. Flexible hinge connection 32 connects the distal leg of the arch-shaped portion of the handle support to the top of brush head 20 at handle end 16.

Brush head 20 has a top that is proximal to the distal leg of the handle and a bottom that is distal to the distal leg of the handle. Brush head 20 has a longitudinal axis that extends generally, in one direction, toward the handle grip, and in the other direction, away from the grip, terminating at a heel in the direction of the grip and at a toe in the direction away from the grip. Bristles 28 depend from the bottom of brush head generally in a direction normal thereto, as shown at 30, and are distributed therealong from the toe to the heel.

Figure 2A:
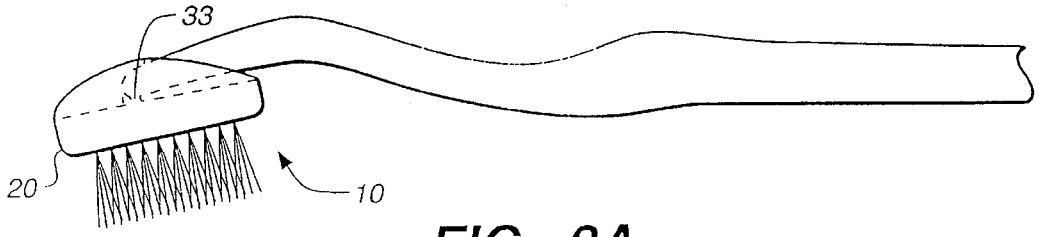
FIG. 2A is a side elevational view of the improved toothbrush of this invention as assembled and illustrating the brush head rotated about the brush head axis to maximum inward rotation.
Figure 3:
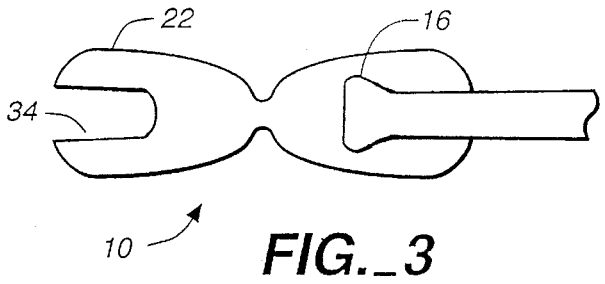
FIG. 3 is a top plan view of the improved toothbrush of this invention in its open unassembled configuration and illustrating the relationship of the handle first end to the brush head top portion guide slot before closure.

Brush head 20 has a main body 24 with a cover section 22, shown in FIG. 1 in a disengaged or disassembled position, which is connected to the toe of the main body 24 by a flexible hinge 26 for rotation to engaged position overlying a portion of the top of main body 24, as shown in FIG. 2A, to form a portion of the top of brush head 20. As seen in FIG. 3, cover section 24 has a handle guide slot 34 which extends longitudinally to provide clearance for rotating cover section 22 to an engaged position around hinge connection 32 and to engage with the distal leg of handle 12, as discussed below.

As best seen in FIG. 1, hinge connection 32 is narrow in the direction parallel with the longitudinal axis of brush head 20. And, as best seen in FIG. 3, hinge connection 32 is broad in the direction transverse to that principal axis, being wide relative to the narrow dimension of the hinge parallel to the brush head axis. This configuration creates a rotational axis for the hinge that is generally normal both to the longitudinal axis of the grip of handle 12 and to the longitudinal axis of brush head 20.

FIG. 2A is a side elevational view of the improved toothbrush 10 of this invention as assembled and illustrating the brush head 20 rotated about the hinge axis to maximum inward rotation. This view also illustrates the general alignment of the hinge pivot axis 33 with the primary longitudinal axis 14 of the handle.

Figure 2B:
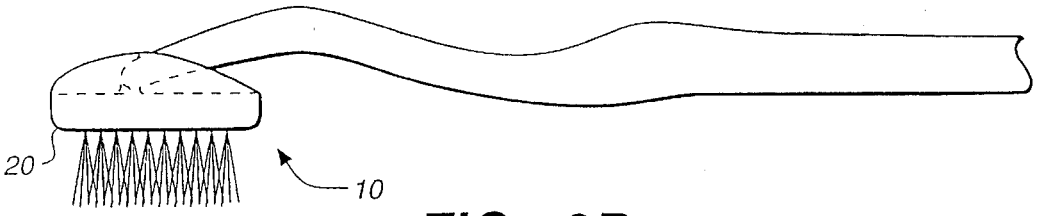
FIG. 2B is a side elevational view of the improved toothbrush of this invention as assembled and illustrating the brush head rotated about the brush head axis to maximum outward rotation.

FIG. 2B is a side elevational view of the improved toothbrush 10 of this invention as assembled and illustrating the brush head 20 rotated about the brush head axis to maximum outward rotation.

FIG. 3 is a top plan view of the improved toothbrush 10 of this invention in its open configuration and illustrating the relationship of the distal leg of the handle to guide slot 34 before closure by pivoting cover 22 to the engaged position at the top of brush head main body 24.

Figure 4:
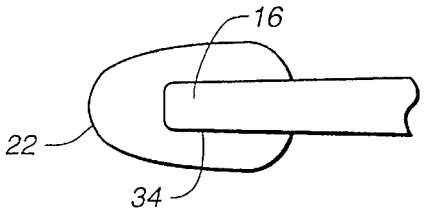
FIG. 4 is a top plan view of the improved toothbrush of this invention in its closed (assembled) configuration and illustrating the relationship of the handle first end to the brush head top portion guide slot after closure.

FIG. 4 is a top plan view of the improved toothbrush 10 of this invention in its closed configuration and illustrating the relationship of the distal leg of the handle to guide slot 34 after closure by pivoting cover 22 to the engaged position at the top of brush head main body 24. Guide slot 34 engages the distal leg at end 16 of handle 12 and permits tangential movement of the distal leg about the hinge axis relative to brush head 20 and provides a brace against turning forces in other directions to thus eliminate any other relative movement. Also, as best seen in FIGS. 4 and 5, the margin of slot 34, at the end toward the cover section pivot abuts the terminal portion of the distal leg of the handle when the brush head longitudinal axis is parallel with the longitudinal axis of the handle grip and thus serves to stop further pivotal movement of the brush head in the direction to move the heel further downward and away from the distal leg.

Figure 5:
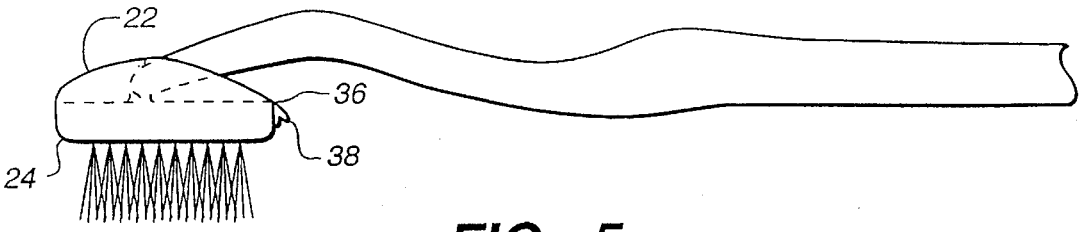
FIG. 5 is a side elevation view of an alternate embodiment of the brush head top and bottom portions bearing a mechanical fastening feature.

FIG. 5 is a side elevation view of an alternate embodiment of the brush head cover section and main body 22, 24 wherein they bear a mechanical fastening feature such as a lip 36 on cover section 24 captured by e snap 38 on main body 22.

Several objects and advantages of the inventive apparatus include:

a. A rotational head.

b. A rotational axis which is perpendicular to the brush handle axis. This maximizes control while allowing the brush head to fit the surface against which it rests while the operator can still move and adjust the brush head position by rotating the brush or bodily movement of the brush handle.

c. While allowing rotation to accommodate brush head position, there are built-in limits to rotation which prevent a brush head position which would be impractical, damaging, or ineffective.

d. The triangular brush head design is intended to fit the bristles of the narrow distal end of the brush head into small areas in the back of the mouth, yet broad at its medial end to cover a wide surface area of the teeth and gums.

e. The small brush head is designed to improve accessibility to all parts of the mouth-regardless of the size of mouth.

f. The current design has higher bristles on the periphery of the brush head with shorter bristles in the center area. This allows for extension of bristle laterally toward the gingiva (gums) of the target area and distally toward back teeth and interproximal dental spaces (between teeth) while leaving the center bristles to be activated on the tooth surfaces.

g. The small area on the brushing surface that does not have bristles is intended to be used as a toothpaste "well" where toothpaste can be placed without concern of falling off the brush. This storage area stabilizes the toothpaste without having to force paste in between the bristles which can cause "caking" of the paste.

h. The brush is a balanced design where a line extending from the axis of the brush handle meets the flexible joint between the handle and the brush head.

i. The handle design allows the brush to "bend" around obstructions or gain access to tooth surfaces in the back of the mouth while maintaining the advantages of the balanced design.

j. The rotational head can accept most of the contemporary bristle types and bristle designs.

k. The brush head has a groove that accepts the distal end of the handle to permit a wider range of rotation without obstruction from the brush head.

l. The broad handle contributes to brush stability.

m. A long handle can be manipulated by large or small hands.

n. The narrow neck of the brush handle is consistent with size of the brush head, yet is broad enough to sustain the stresses of abuse.

o. The back (non-bristle) side of the brush head is contoured to contribute to the compact head design and is tapered at all edges to permit smooth movement without any interference to brush movement and improve the fit of the brush head into tight spaces.

p. The hinge is generally closed during use; covered by the back of the brush head. This will prevent any pinching or snagging of oral tissues. The contours of the back of the brush head are designed to enhance this protective characteristic.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims.

What is claimed as invention is:

1. An articulate toothbrush comprising a handle, a brush and a hinge connection therebetween and wherein:

a. the handle comprises an elongate grasp, for grasping about the longitudinal axis thereof, and a brush support connected to one end of the grasp, extending away from the grasp generally in the direction of the longitudinal axis of the grasp and having a generally arch-shaped portion with a leg of the arch-shaped portion proximal to the grasp diverging from the longitudinal axis thereof and having a leg distal to the grasp that extends back toward the longitudinal axis at an acute angle therewith to the axis of rotation of the hinge connection with the brush.

b. the brush comprises a head having a longitudinal axis that extends, in one direction, toward the grip, the head terminating in that direction at a heel, and, in the other direction, away from the grip, the head terminating in that direction at a toe, and having a top proximal to the hinge connection with the distal leg of the support and a bottom distal to the hinge connection with the support, the bottom having bristles depending therefrom and generally distributed therealong from the toe to the heel of the head and c. the hinge connection comprises a flexible hinge connecting the distal leg of the support and the top of the brush head, at an intermediate position between the heel and toe, the hinge being comprised of flexible plastic and having a narrow breadth in the direction parallel to the longitudinal axis of the head and a wide breadth in the direction transverse to the longitudinal axis of the brush head, relative to the breadth thereof parallel to the longitudinal axis of the brush head, whereby to create the hinge axis of rotation of the hinge connection, the hinge axis of rotation being generally normal to the longitudinal axis of the grasp and to the longitudinal axis of the brush head for relative pivotal movement therebetween within a range of movement extending over a predetermined acute angle arc from a position where the longitudinal axis of the brush head is parallel with the longitudinal axis of the grasp to move the heel of brush head toward the distal leg of the support over the predetermined acute angle arc.

2. A toothbrush as in claim 1 and wherein the axis of rotation of the hinge connection is located substantially at the longitudinal axis of the grasp.

3. A toothbrush as in claim 1 and wherein the toothbrush further comprises means for stopping pivotal movement of the brush at either end of the predetermined arc.

4. A toothbrush as in claim 3 and wherein the stop means comprises an exterior part of the distal leg facing the top of the brush head when the heel of brush head is rotated in the direction of the distal leg.

5. A toothbrush as in claim 4 and wherein the top of the brush head has a slot extending centrally in the longitudinal direction along the brush head toward the heel from the location of the hinge connection with the top of the head, the slot being shaped to receive the distal leg of the support when the heel of brush head is rotated in the direction of the distal leg, whereby to provide a protective recess for the hinge connection and a brace against turning moments imposed on the brush head, during use, in directions other than about the hinge axis.

6. An integrally molded toothbrush of flexible plastic for an articulate toothbrush comprising a handle, a brush with a separate cover section and a flexible hinge connection between the brush and the handle and wherein:

a. the handle comprises an elongate grasp, for grasping about the longitudinal axis thereof, and a brush support connected to one end of the grasp, extending away from the grasp generally in the direction of the longitudinal axis of the grasp and having a generally arch-shaped portion with a leg of the arch-shaped portion proximal to the grasp diverging from the longitudinal axis thereof and having a leg distal to the grasp that extends back toward the longitudinal axis at an acute angle therewith to the axis of rotation of the hinge connection with a brush, b. the brush comprises a head having a longitudinal axis that extends, in one direction, toward the grip, the head terminating in that direction at a heel, and, in the other direction, away from the grip, the head terminating in that direction at a toe, and having a top proximal to the hinge connection with the distal leg of the support and a bottom distal to the hinge connection with the support, the bottom having bristles depending therefrom and generally distributed therealong from the toe to the heel of the head, c. the flexible hinge connection is between and integrally molded with the distal leg of the support and the top of the brush head at an intermediate position between the heel and toe, the hinge connection is comprised of flexible plastic and has a narrow breadth in the direction parallel to the longitudinal axis of the head and a wide breadth in the direction transverse to the longitudinal axis of the brush head, relative to the breadth thereof parallel to the brush head, whereby to create the hinge axis of rotation of the hinge connection, the hinge axis of rotation being generally normal to the longitudinal axis of the grasp and to the longitudinal axis of the brush head for relative pivotal movement therebetween within a range of movement extending over a predetermined arc and d. the separate cover section is adapted to be secured to the brush head to form a part of the top thereof, the cover section being connected to the toe of the brush head at an end of the cover section extending transverse to longitudinal direction thereof through an integrally molded flexible hinge joint, the cover section having a slot extending centrally in the longitudinal direction thereof from a medial location to the opposed end of the cover section and the cover section being pivotable around the hinge joint with the brush head to engage the brush head and form a portion thereof, with the slot extending from the location of the hinge connection of the distal leg with the top of the head along the brush head toward the heel to receive the distal leg of the support when the heel of brush head is rotated in the direction of the distal leg, whereby to provide a protective recess for the hinge connection and a brace against turning forces imposed on the brush head, during use in directions other than about the hinge axis.

7. A toothbrush as in claim 6, and wherein the slot at the medial end thereof has a margin that is so positioned that, when the cover section is engaged and the brush head is pivoted in the direction to move the heel of the brush head away from the distal leg to a position beyond the position where the longitudinal axis of the brush is parallel with the longitudinal axis of the grasp, the slot margin will engage the distal leg to stop further pivotal movement in that direction.

8. An articulate toothbrush integrally molded from flexible plastic material comprising a handle, a brush and a flexible hinge connection therebetween and wherein:

a. the handle comprises an elongate grasp, for grasping about the longitudinal axis thereof, and a brush support connected to one end of the grasp, extending away from the grasp generally in the direction of the longitudinal axis of the grasp and having a generally arch-shaped portion with a leg of the arch-shaped portion proximal to the grasp diverging from the longitudinal axis thereof and having a leg distal to the grasp that extends back toward the longitudinal axis at an acute angle therewith to the axis of rotation of the hinge connection with the brush, b. the brush comprises a head having a longitudinal axis that extends, in one direction, toward the grip, the head terminating in that direction at a heel, and, in the other direction, away from the grip, the head terminating in that direction at a toe, and having a top proximal to the hinge connection with the distal leg of the support and a bottom distal to the hinge connection with the support, the bottom having bristles depending therefrom and generally distributed therealong from the toe to the heel of the head and c. the flexible hinge connection between and integrally molded with the distal leg of the support and the top of the brush head at an intermediate position between the heel and toe, the hinge connection being comprised of flexible plastic and having a narrow breadth in the direction parallel to the longitudinal axis of the head and a wide breadth in the direction transverse the longitudinal axis of the brush head, relative to the breadth thereof parallel to the brush head, whereby to create the hinge axis of rotation of the hinge connection, the hinge axis of rotation being generally normal to the longitudinal axis of the grasp and to the longitudinal axis of the brush head for relative pivotal movement therebetween within a range of movement extending over a predetermined acute angle arc.

9. A toothbrush as in claim 8 and wherein the axis of rotation of the pivot connection is located substantially at the longitudinal axis of the grasp.

10. A toothbrush as in claim 8 and wherein the bristles depending from the brush head are generally perpendicular to the longitudinal axis of the brush head and to the hinge axis.

11. A toothbrush as in claim 8 and wherein the toothbrush further comprises means for stopping pivotal movement of the brush at either end of the predetermined arc.

12. A toothbrush as in claim 8 and wherein the top of the brush head is recessed at the location of the hinge connection whereby to shield the hinge joint from entry by mouth tissues.

13. A toothbrush as in claim 12 and wherein a slot extends in the longitudinal direction of the brush head from the recess toward the heel sized to receive the distal leg of the support as the heel of the brush head rotates in the direction of the distal leg whereby during brushing to support the pivotal connection against turning forces in directions other than about the pivot axis and shield the margins between the distal leg and top of the brush head from entry and pinching of mouth tissue.

14. A toothbrush as in claim 13 and wherein the slot, at the medial end thereof, has a margin so positioned that, when the brush head is pivoted in the direction to move the heel of the brush head away from the distal leg to a position beyond the position where the longitudinal axis of the brush is parallel with the longitudinal axis of the grasp, the slot margin will engage the distal leg to stop further pivotal movement in that direction.

15. A toothbrush as in claim 12 and wherein the brush head includes a separate cover section that forms a part of the top thereof and is secured thereto, the cover section having a slot extending centrally in the longitudinal direction along the brush head toward the heel from the location of the hinge connection with the top of the head, the slot being shaped to receive the distal leg of the support when the heel of brush head is rotated in the direction of the distal leg, whereby to provide a protective recess for the hinge connection and a brace against turning forces imposed on the brush head, during use, in directions other than about the hinge axis.

16. A toothbrush as in claim 15 and wherein the cover section is connected to the toe of the brush head at an end of the cover section extending transverse to longitudinal direction thereof through an integrally molded flexible hinge joint, the cover section being pivotable around the hinge joint with the brush head from a disengaged position, at which the cover section is remote from brush head about the hinge axis, to engage the brush head at which the cover section forms a portion thereof, with the slot extending from the location of the hinge connection of the distal leg with the top of the head along the brush head toward the heel to receive the distal leg of the support when the heel of brush head is rotated in the direction of the distal leg, whereby to permit molding the brush head and the cover section therefor in separate, disengaged but connected parts and easy assembled by rotation of the separate cover section from the disengaged position to the engaged position.

17. A toothbrush as in claim 15 and wherein the brush head has means for securing the cover section in the engaged position operable by a user to secure the cover section and to disengage the cover section after the cover section is secured.

18. A toothbrush as in claim 8 and wherein the predetermined acute angle arc is up to 35 degrees.

19. A toothbrush as in claim 8 and wherein the axis of rotation of the hinge connection between the distal leg of the support and the top of the brush head is located at a position along the longitudinal axis of the brush head that is in the direction toward the toe from the midpoint between the heel and the toe.

20. A toothbrush as in claim 19 and wherein the axis of rotation of the hinge connection is located substantially closer to the midline than to the toe of the brush head.

* * * * *